United States Patent [19]

Haworth

[11] 3,948,242

[45] Apr. 6, 1976

[54] BALL THROWING MACHINE WITH OSCILLATING MEANS

[76] Inventor: James G. Haworth, 100 Green Lane, Eugene, Oreg. 97402

[22] Filed: Mar. 19, 1975

[21] Appl. No.: 559,728

[52] U.S. Cl. ..... 124/7; 124/36

[51] Int. Cl.[2] ..... F41B 3/00

[58] Field of Search ..... 124/7, 8, 9, 1, 6, 36, 124/41 R, 50, 49

[56] References Cited

UNITED STATES PATENTS

| | | | |
|---|---|---|---|
| 3,097,635 | 7/1963 | Freeman | 124/8 |
| 3,568,653 | 3/1971 | Earle | 124/9 X |
| 3,585,978 | 6/1971 | Hurlimann | 124/41 R X |
| 3,757,759 | 9/1973 | Haworth | 124/7 |

*Primary Examiner*—Richard C. Pinkham
*Assistant Examiner*—William R. Browne
*Attorney, Agent, or Firm*—Robert G. Slick

[57] ABSTRACT

A ball throwing machine with oscillating capability is provided wherein the machine has a single shaft which rotates within a tube having bearings therein and wherein said tube is supported at only a single place near the center of the tube. The mechanism for oscillating the ball throwing machine is caused to rotate by the same mechanism that causes the throwing arm, which is directly connected to the shaft, to rotate. The oscillating mechanism drives a cam. A cam follower, which is connected to the throwing machine, is spring biased against the cam. As the cam rotates the cam follower and the throwing machine will be oscillated.

1 Claim, 4 Drawing Figures

BALL THROWING MACHINE WITH OSCILLATING MEANS

SUMMARY OF THE INVENTION

Ball throwing machines having an oscillating feature are well known as is typlified by my previous patent.

The devices used heretofore have had the disadvantage that the throwing arm is carried by a shaft and that other moving parts depend upon the actuation of this shaft, such as the oscillation of the machine and ball feeding. Further, the devices used in the past have ordinarily employed a main shaft which was supported by bearings at multiple points on a frame, resulting in a relatively bulky device.

In accordance with the present invention, an improved oscillating throwing device is provided wherein the main shaft is not subjected to any stress other than that needed to actuate the arm. The ball feeding and oscillation devices are driven independently of the main throwing shaft. Further in accordance with my invention, the main shaft is carried within a tube and the drive sprocket and oscillator drives are mounted for rotation on the outside of the same tube; the tube itself is mounted on the frame of the machine at only a single central point. This allows the frame of the machine to be in the form of a single plate which is mounted for oscillation, greatly simplifying the oscillation mechanism.

Thus, the present invention provides a simplified, yet rugged oscillating ball throwing mechanism. Obviously, the manufacturing cost of such a device is substantially less than similar devices which have been used in the past.

Various other features and advantages of the invention will be brought out in the balance of the specification.

DESCRIPTION OF THE PREFERRED EMBODIMENTS

Figure 1:
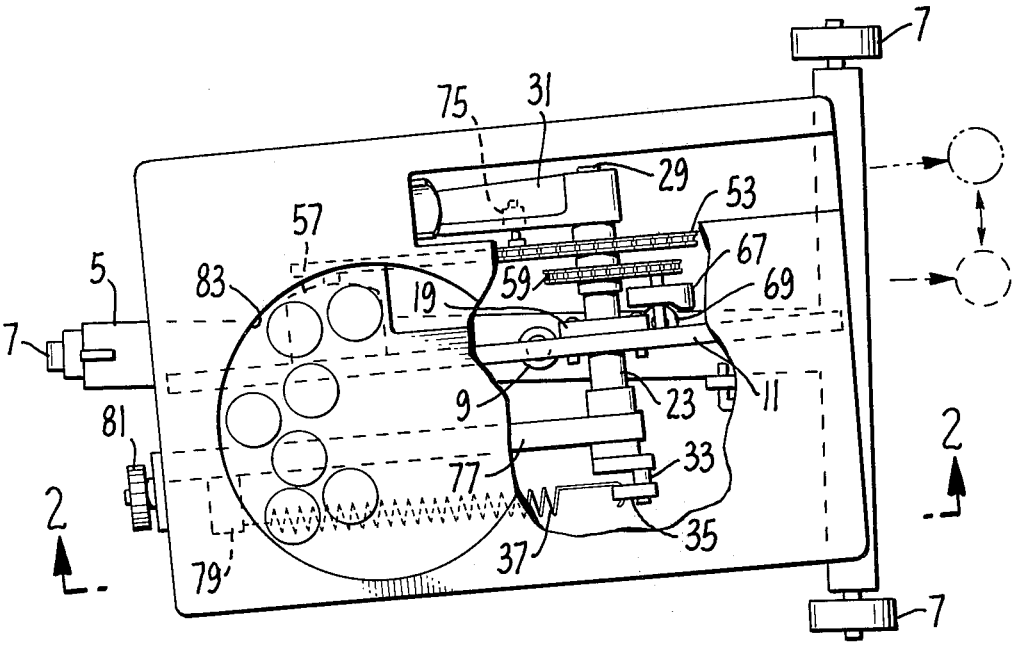
FIG. 1 is a top view of a machine embodying the present invention with a portion of the top of the cabinet cut away to show the mechanical parts.

The ball throwing device of the present invention is mounted on a T-shaped base 5, preferably on rollers 7. Base 5 has a stub shaft 9 mounted thereon which carries a frame plate 11 which has suitable bearings 13 thereon so that frame plate 11 can rotate with respect to base 5. Suitable stops 15 and 17 can be provided to limit the angle of rotation.

Figure 3:
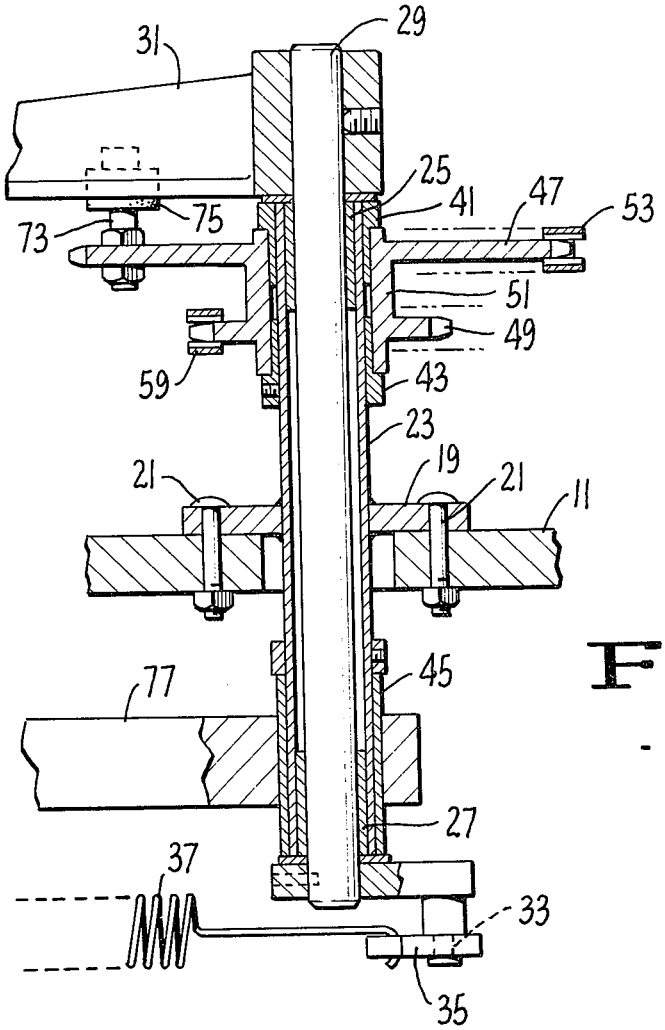
FIG. 3 is an enlarged section on the line 3—3 of FIG. 2.
Figure 4:
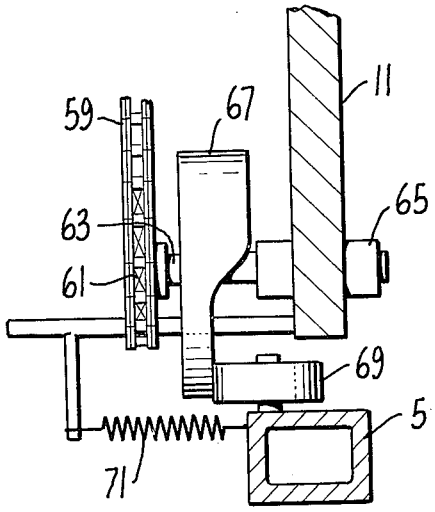
FIG. 4 is an enlarged section on the line 4—4 of FIG. 2.

As can best be seen in FIG. 3, the frame plate 11 has a plate 19 attached thereto by means of bolts 21. Plate 19 carries a tube 23 which is rigidly attached thereto, suitably by welding. Of course, tube 23 could be directly attached to frame 11, but the mounting arrangement described is preferred since it simplifies assembly and maintenance. Tube 23 has internal bearings 25 and 27 substantially at each end thereof and shaft 29 is mounted for rotation in these bearings. Shaft 29 carries a throwing arm 31 at one end thereof and a crank 33 at the opposite end. Crank 33 carries a yoke 35 to which is attached throwing springs 37 and 39.

Tube 23 is provided with external bearings 41 and 43 near one end and 45 at the opposite end.

Mounted on bearings 41 and 43 is a double sprocket including a large sprocket 47 and a small sprocket 49 on a common hub 51. The large sprocket is connected by a suitable roller chain 53 to the drive motor 57 which is mounted on the frame plate 11. The smaller sprocket 49 is connected by means of a similar chain 59 to a sprocket 61 carried on shaft 63 which is mounted for rotation by means of bearing 65 attached to the frame plate 11. Shaft 63 carries a cam 67 which is biased into contact with a roller 69 mounted on frame 5 by means of spring 71.

Sprocket 47 carries an arm 73 having a roller 75 thereon which bears against, but is not connected to, the throwing arm 31.

Mounted on bearing 45 is arm 77 which carries spring holder 79 to which is attached springs 37 and 39. Tension and elevation angle can be adjusted by means of a knob 81 at the end of arm 77.

Figure 2:
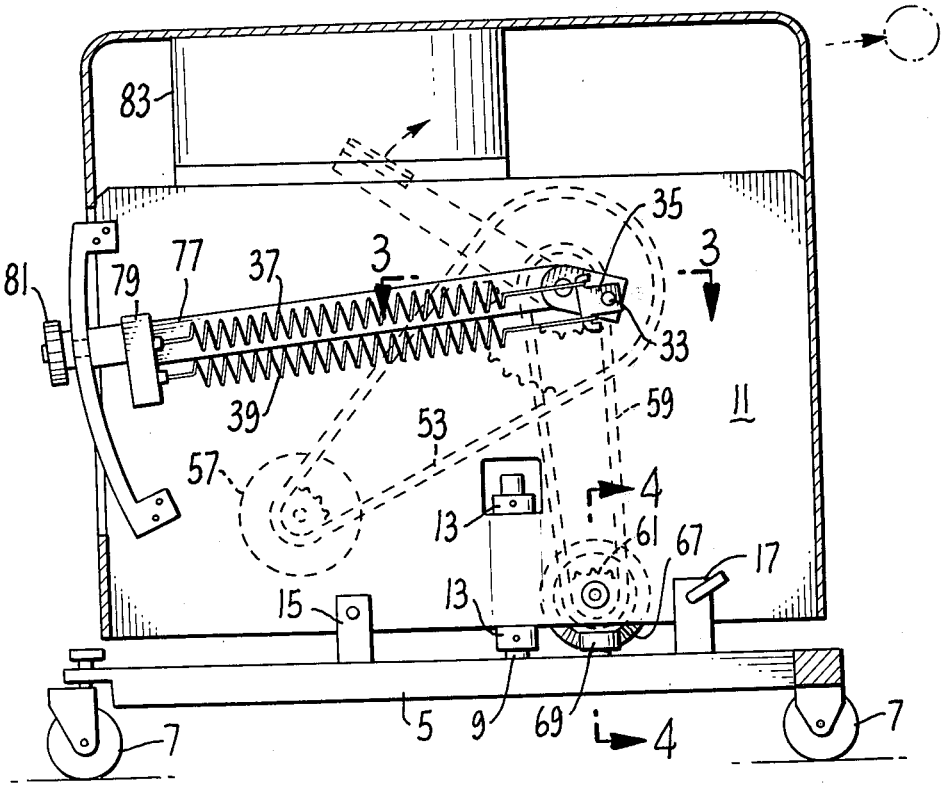
FIG. 2 is a section on the line 2—2 of FIG. 1.

The operation of the device is that as sprocket 47 is driven by the motor 57, pin 73 rotates arm 31 causing it to pick up a ball from the ball hopper 83. At the same time, arm 31 turns shaft 29 which stretches springs 37 and 39. Now as the crank pin 33 passes over the apogee center, the stretched springs will cause arm 31 to leave roller 75 and rapidly propel a ball as is well known to those skilled in the art. This action is shown in dash lines in FIG. 2. Roller 75 will eventually catch up with arm 31 for a repetition of the operation. At the same time, cam 67 will cause the frame 11 to oscillate, changing the azimuth angle of the ball propelled. Since sprockets 49 and 61 are ordinarily of different sizes, the oscillation and the ball throwing will be at different frequencies, resulting in a random angle, which is highly desirable for practice purposes.

I claim:

1. An oscillating ball throwing machine comprising:

a. a base member, b. a stub shaft extending upwardly from said base member, c. a substantially flat, rectangular, vertically positioned frame plate having bearings thereon mounted for rotation on said stub shaft whereby said frame plate can rotate on its vertical axis above said base member, d. a tube fixed at a right angle to said frame plate and fastened to said frame plate at only the center of said tube, e. a shaft mounted for rotation within said tube, said shaft carrying a ball throwing arm at one end and a crank shaft at the opposite end, said crank shaft being connected to ball propelling springs, f. a double sprocket journaled for rotation on the outside of said tube, said double sprocket including a first sprocket carrying an arm adapted to contact said ball throwing arm and to push against said arm which is free to rotate relative thereto, a prime mover being mounted upon said frame plate, said first sprocket being driven by said prime mover, g. a cam mounted for rotation on said frame plate and a cam follower mounted on said base member and spring bias means urging said cam against said cam follower whereby said frame plate is caused to oscillate upon rotation of said cam, h. said double sprocket including a second sprocket attached to said first sprocket and being drivingly connected to said cam, and i. a spring holding arm mounted for rotation on said tube, ball propelling springs, said arm having attached thereto said ball propelling springs.

* * * * *